US012232607B2

(12) United States Patent
Wangberg et al.

(10) Patent No.: US 12,232,607 B2
(45) Date of Patent: Feb. 25, 2025

(54) LEG ASSEMBLY FOR BAR EQUIPMENT

(71) Applicant: Perlick Corporation, Milwaukee, WI (US)

(72) Inventors: Lee M. Wangberg, West Bend, WI (US); Dennis P. Biesiada, Milwaukee, WI (US)

(73) Assignee: Perlick Corporation, Milwaukee, WI (US)

( * ) Notice: Subject to any disclaimer, the term of this patent is extended or adjusted under 35 U.S.C. 154(b) by 21 days.

(21) Appl. No.: 18/229,575

(22) Filed: Aug. 2, 2023

(65) Prior Publication Data

US 2024/0041200 A1 Feb. 8, 2024

Related U.S. Application Data

(60) Provisional application No. 63/395,715, filed on Aug. 5, 2022.

(51) Int. Cl.
*A47B 3/00* (2006.01)
*A47B 13/02* (2006.01)

(52) U.S. Cl.
CPC ..... *A47B 13/021* (2013.01)

(58) Field of Classification Search
CPC ..... A47B 13/021; A47B 13/003; A47B 69/00; A47B 91/005; A47B 3/06; A47B 91/00; A47B 97/00; A47F 9/00
See application file for complete search history.

(56) References Cited

U.S. PATENT DOCUMENTS 3,572,787 A * 3/1971 Timmerman ..... F16B 12/44 248/188
3,960,352 A * 6/1976 Plattner ..... F16M 11/045 248/188.4
4,838,181 A * 6/1989 Luyk ..... A47B 13/021 248/188
5,109,778 A * 5/1992 Berkowitz ..... A47B 3/0911 108/127
5,323,713 A * 6/1994 Luyk ..... A47B 3/0815 108/131
5,673,633 A * 10/1997 Pfister ..... A47B 3/0815 108/131
6,557,712 B2 5/2003 Gruber et al.
6,718,609 B2 4/2004 Gruber et al.
(Continued)

FOREIGN PATENT DOCUMENTS

FR 2762495 A1 10/1998
GB 972306 A 10/1964
(Continued)

*Primary Examiner* — Amy J. Sterling
(74) *Attorney, Agent, or Firm* — Quarles & Brady LLP

(57) ABSTRACT

A leg assembly for a bar arrangement can include one or more legs, a mounting channel, and a securing knob. The mounting channel can be secured to the bar arrangement via a toolless connection. Primary receiving nuts can be used to secure the channel to the bar arrangement via engagement with the one or more legs and the securing knob. A second leg can be secured to the mounting channel via a secondary receiving nut at a specified location along the mounting channel. The specified location of the second leg can position the second leg away from a back wall or other obstacle to provide an accommodation space under the bar arrangement.

20 Claims, 10 Drawing Sheets

(56) References Cited

U.S. PATENT DOCUMENTS

| | | | | |
|---|---|---|---|---|
| 7,124,903 | B2 | 10/2006 | Gruber et al. | |
| 7,337,516 | B2 | 3/2008 | Gruber et al. | |
| 8,215,246 | B2 * | 7/2012 | Quam | E04H 3/28 108/159.11 |
| 9,835,284 | B2 | 12/2017 | Gandole et al. | |
| 9,885,377 | B2 | 2/2018 | Ku | |
| 9,947,302 | B2 | 4/2018 | Canivell Grifols et al. | |
| 10,119,649 | B2 | 11/2018 | Grandole et al. | |
| 10,362,861 | B1 * | 7/2019 | Patton | A47B 13/003 |
| 11,051,617 | B2 * | 7/2021 | Cheng | A47B 91/024 |
| 2006/0096506 | A1 | 5/2006 | Brauning et al. | |
| 2015/0325224 | A1 | 11/2015 | Manosa Ripoll et al. | |
| 2021/0018028 | A1 | 1/2021 | Hutson | |
| 2021/0052064 | A1 | 2/2021 | Miller et al. | |

FOREIGN PATENT DOCUMENTS

| | | | |
|---|---|---|---|
| GB | 996073 | A | 6/1965 |
| GB | 2331234 | A | 5/1999 |
| JP | 2006136551 | A | 6/2006 |

* cited by examiner

LEG ASSEMBLY FOR BAR EQUIPMENT

CROSS-REFERENCE TO RELATED APPLICATION

This application claims priority to U.S. Provisional Application No. 63/395,715, filed Aug. 5, 2022, which is hereby incorporated by reference in its entirety for all purposes.

TECHNICAL FIELD

The present disclosure is generally related to bar arrangements and underbar leg attachment arrangements, which may be used in a variety of establishments, including restaurants, bars, and other commercial, industrial, or residential settings. More specifically, the present disclosure relates to a leg assembly and attachment mechanism for securing the leg assembly to an underside of a bar or bar arrangement.

BACKGROUND

Restaurants, bars, taverns, clubs, and other establishments often use one or more bar or bar arrangements to aid in food and beverage preparation and storage. Such bar and bar arrangements can include, for example, temperature-regulated storage compartments (e.g., refrigerators and freezers), wash stations (e.g., sinks and dishwashers), and other storage and preparation areas. Generally, bar and bar arrangements are supported by a leg, base, or stand assembly that typically elevates an underbar area of the bar or bar arrangement off of the ground. In use, the underbar can be employed to generally accommodate bar elements of the bar arrangement or kitchen environment, such as plumbing, wiring, and other associated conduits. In some instances and installments of bar and bar arrangements, the leg, base, or stand assembly can interfere with the plumbing, wiring, or other associated conduits that engage or pass by the bar adjacent to a floor, wall (e.g., back wall), or corner.

In this regard, it may be generally useful to provide a leg assembly for use with a bar or bar arrangement that can be adjusted or fitted to a particular bar environment. Such leg assembly may be employed to avoid interference with plumbing, wiring, conduits, vents, or other kitchen/bar obstacles. The leg assembly may be used to support the bar or bar arrangement in a particular location or orientation in the bar environment that may otherwise require inconvenient, undesirable, or impractical modification to the plumbing, wiring, conduits, etc. of the environment or the bar arrangement itself.

SUMMARY

Embodiments of the invention can provide a leg assembly for a bar arrangement. The bar arrangement can define a back side for arranging along a wall and a front side opposite to the back side. The leg assembly can include a mounting channel for engaging the bar arrangement at an underneath portion (e.g., underbar area) of the bar arrangement. A first leg can be secured relative to the mounting channel via a first primary receiving nut adjacent to the front side of the bar arrangement. A securing knob can be secured relative to the mounting channel via a second primary receiving nut adjacent to the back side of the bar arrangement. A second leg can be secured to the mounting channel via a first secondary receiving nut. The second leg can be secured along the mounting channel at a position between the first leg and the securing knob to form an accommodation space at the underneath portion of the bar arrangement between the second leg and the wall.

In some embodiments, a leg assembly for a bar arrangement can include a second leg that is offset from a wall by an offset distance.

In some embodiments, a leg assembly for a bar arrangement can include a second leg that is offset from a wall by approximately 5.5 inches, or between 4 and 8 inches.

In some embodiments, a leg assembly for a bar arrangement can include a first leg that includes a threaded stud that is dimensioned to be threadably received by a first primary receiving nut. A second leg can include a threaded stud that is dimensioned to be threadably received by a first secondary receiving nut.

In some embodiments, a leg assembly for a bar arrangement can include a securing knob that includes a grip portion and a threaded member. The threaded member can be dimensioned to be threadably received by a second primary receiving nut.

In some embodiments, a leg assembly for a bar arrangement can include a mounting channel. The mounting channel can include a slot and a second leg can be infinitely adjustable within the mounting channel along a length of the slot.

In some embodiments, a leg assembly for a bar arrangement can include a first leg, a second leg, and a securing knob. Each of the first leg, the second leg, and the securing knob can be secured to a mounting channel, and thus the bar arrangement, without tools.

In some embodiments, a leg assembly for a bar arrangement can include first and second primary receiving nuts that are configured to secure a mounting channel to the bar arrangement via a first leg and a securing knob.

In some embodiments, a leg assembly for a bar arrangement can include a first primary receiving nut and a first leg. A portion of the bar arrangement can be configured to be clamped between the first primary receiving nut and the first leg.

Embodiments of the invention can provide a leg assembly for a bar arrangement. The bar arrangement can define a back side for arranging along a wall and a front side opposite to the back side. The leg assembly can include a mounting channel, a first primary receiving nut, a second primary receiving nut, a securing knob, a first leg, and a second leg. The mounting channel can engage the bar arrangement at an underneath portion of the bar arrangement. The mounting channel can include first and second distal ends. The first primary receiving nut can be disposed at the first distal end of the mounting channel and the second primary receiving nut can be disposed at the second distal end of the mounting channel. The securing knob can be secured relative to the mounting channel via the first primary receiving nut or the second primary receiving nut. The first and second legs can be secured relative to the mounting channel. The second leg can be secured relative to the mounting channel at a position between the first leg and the securing knob to form an accommodation space at the underneath portion of the bar arrangement between the second leg and the front side of the bar arrangement or between the second leg and the back side of the bar arrangement.

In some embodiments, a leg assembly for a bar arrangement can include an accommodation space formed by a second leg secured to a mounting channel via secondary receiving nut that is offset from one of a first distal end or a second distal end of the mounting channel.

In some embodiments, a leg assembly for a bar arrangement can include a mounting channel that includes a track. A secondary receiving nut can include arms dimensioned to engage the track. A secondary receiving nut can be infinitely adjustable along the track.

In some embodiments, a leg assembly for a bar arrangement can include a nut having arms that extend longitudinally along a track so that the nut is inhibited from rotation by an interaction between the arms and the track when a second leg is rotated relative to the track and received by the nut.

In some embodiments, a leg assembly for a bar arrangement can include a mounting channel. The mounting channel can include first and second secondary receiving nuts. The first and second secondary receiving nuts can be arranged between first and second primary receiving nuts.

In some embodiments, a leg assembly for a bar arrangement can include a mounting channel that extends between a back side and a front side of the bar arrangement.

In some embodiments, a leg assembly for a bar arrangement can include a second leg. An accommodation space can be formed between the second leg and a wall.

In some embodiments, a leg assembly for a bar arrangement can include one or more alignment pins that extend from a mounting channel and through a head of a first primary receiving nut to secure the first primary receiving nut laterally between first and second distal ends of the mounting channel.

In some embodiments, a leg assembly for a bar arrangement can include first and second alignment pins that are configured to prohibit rotation of a primary receiving nut relative to a mounting channel.

Embodiments of the invention can provide a method for adjusting a leg assembly for a bar arrangement. The bar arrangement can define a back side for arranging along a wall and a front side opposite to the back side. The method can include securing a first distal end of a mounting channel to the bar arrangement by securing a first leg to a first primary receiving nut. The method can further include securing a second distal end of the mounting channel to the bar arrangement by securing a knob to a second primary receiving nut. The method can further include slidably securing a second leg to the mounting channel via a secondary receiving nut. The second leg can be positioned between the first leg and the knob. The method can further include adjusting the position of the second leg along the mounting channel to form an accommodation space between the second leg and the wall. The method can further include securing the second leg relative to the mounting channel by rotating the second leg relative to the secondary receiving nut.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
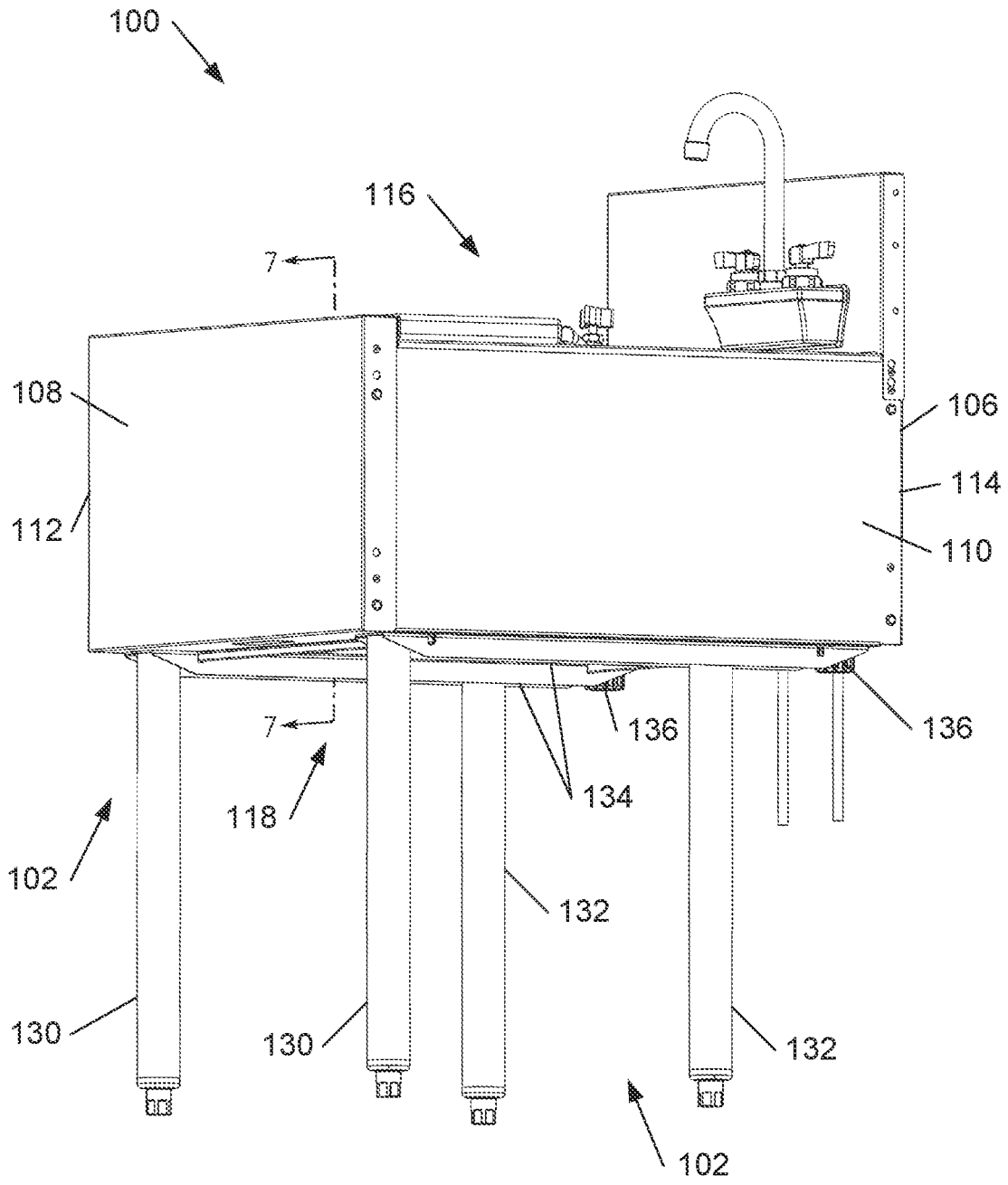
FIG. 1 is an isometric view of an example bar arrangement and example leg assemblies according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Given the benefit of this disclosure, various modifications to the illustrated embodiments will be readily apparent to those skilled in the art, and the principles herein can be applied to other embodiments and applications without departing from embodiments of the invention. Thus, embodiments of the invention are not intended to be limited to embodiments shown but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

As used herein, unless otherwise defined or limited, directional terms are used for convenience of reference for discussion of particular figures or examples. For example, references to downward (or other) directions or top (or other) positions may be used to discuss aspects of a particular example or figure, but do not necessarily require similar orientation or geometry in all installations or configurations.

Also as used herein, unless otherwise limited or defined, "integral" and derivatives thereof (e.g., "integrally") describe elements that are manufactured as a single piece without fasteners, adhesive, or the like to secure separate components together. For example, an element stamped, cast, or otherwise molded as a single-piece component from a single piece of sheet metal or using a single mold, without rivets, screws, or adhesive to hold separately formed pieces together is an integral (and integrally formed) element. In contrast, an element formed from multiple pieces that are separately formed initially then later connected together is not an integral (or integrally formed) element.

Additionally, unless otherwise specified or limited, the terms "about" and "approximately," as used herein with respect to a reference value, refer to variations from the reference value of +15% or less, inclusive of the endpoints of the range. Similarly, the term "substantially equal" (and the like) as used herein with respect to a reference value refers to variations from the reference value of less than +30%, inclusive. Where specified, "substantially" can indicate in particular a variation in one numerical direction relative to a reference value. For example, "substantially less" than a reference value (and the like) indicates a value that is reduced from the reference value by 30% or more, and "substantially more" than a reference value (and the like) indicates a value that is increased from the reference value by 30% or more.

As briefly discussed above, some bars and bar arrangements may be installed in environments having certain obstacles or obstructions such as wiring, pipes, conduits, vents, ducts, drains, access panels, or storage areas, for example. Unfortunately, conventional bar arrangements may include legs or leg assemblies that undesirably interfere with such obstacles or obstructions. In this regard, some bar arrangements and/or their environments may require burdensome modification or replanning to fit a certain bar arrangement in a certain environment.

Embodiments of the present invention address these and other drawbacks of conventional legs of a bar arrangement. In particular, embodiments of the present invention can provide a leg assembly for a bar arrangement that can adjust the position of one or more legs for a bar arrangement to provide an accommodation space under the bar so that the legs do not interfere with obstacles or obstructions under the bar assembly. For example, embodiments of the present invention can provide leg assemblies that position a set of rear legs of the bar arrangement away from a back wall against which the bar arrangement is aligned with or otherwise arranged on. The rear legs can be secured to the bar arrangement via the leg attachment assembly at a position that is offset from the back wall. In addition to an improved leg position, embodiments of the invention can advantageously provide a method of toolless connection of the leg assembly to a bar arrangement.

Referring now to FIG. 1, an example bar arrangement 100 including an example leg assembly 102 according to an embodiment of the invention is shown. In the illustrated embodiment, the bar arrangement 100 is generally configured as a sink. However, it should be appreciated that other bar arrangements and configurations are possible. For example, some bar arrangements can include one or more of a variety of components or areas, including a sink, refrigeration compartments, freezer compartments, warming compartments, storage units, dispensers, preparation surfaces, dishwashers, and other bar appliances and accessories.

The bar arrangement 100 can define a body 106. In some embodiments, the body 106 can include a front side 108, first and second lateral sides 110, 112, and a back side 114. The body 106 can also generally define a top area 116 and an underneath portion 118 that faces the ground (e.g., floor of the installation site). In the illustrated embodiment, first and second leg assemblies 102 are secured to the body 106 at the underneath portion 118. One leg assembly 102 is generally adjacent to the first lateral side 110 of the body 106 and extends between the front side 108 and the back side 114 and the other leg assembly 102 is generally adjacent to the second lateral side 112 of the body and extends between the front side 108 and the back side 114.

The bar arrangement 100 illustrated in FIG. 1 shows first and second leg assemblies 102 secured to the underneath portion 118 of the body 106, however, other bar arrangements can include more or fewer leg assemblies. For example, if a bar arrangement is partially mounted to or supported by another structure, such as a wall, only a single leg assembly may be required to support the body of such bar arrangement. Additionally, in other embodiments, a larger bar assembly may use more than two leg assemblies to support the bar assembly.

In the illustrated embodiment, each leg assembly 102 includes a front leg 130, a rear leg 132, a mounting channel 134, and a securing knob 136. As shown, the leg assembly 102 can be mounted to the underneath portion 118 of the body 106 with the front leg 130 adjacent to the front side 108 of the body 106, the securing knob 136 adjacent to the back side 114 of the body 106, and the rear leg 132 positioned between the front leg 130 and the securing knob 136 along the mounting channel 134. In general, the securing knob 136 allows the leg assembly 102 to be mounted and secured to the body 106 of the bar arrangement 100 without tools (e.g., drivers, wrenches, etc.). Thus, the securing knob 136 provides a toolless connection of the leg assembly 102 to the bar arrangement 100.

Figure 2:
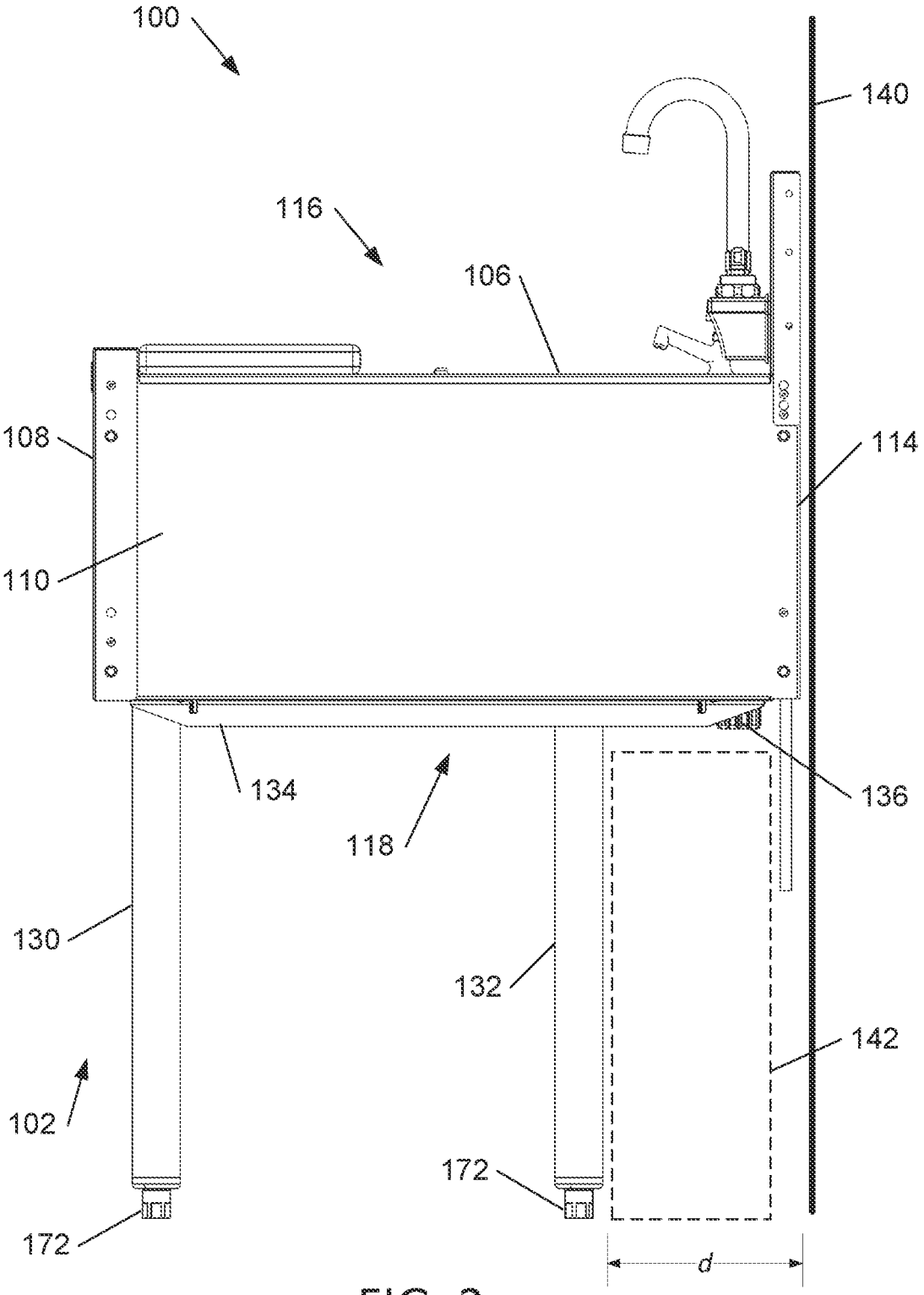
FIG. 2 is side view of the bar arrangement and an example leg assembly of FIG. 1.

With reference to FIG. 2, in some environments, a bar arrangement similar to the bar arrangement 100 may be placed against or in close proximity to a wall 140 or other structure. For example, in some environments, the back side 114 of the bar arrangement 100 may be positioned along a wall 140 so that there is little or no gap between the back side 114 of the body 106 and the wall 140 or other structure. Additionally, as described above, often kitchen and bar environments include a variety of elements or obstacles, such as plumbing, wiring, conduits, vents, covers, access panels, etc. near the floor and/or wall. In this regard, the bar arrangement 100, and particularly the leg assembly 102, can advantageously provide accommodating space for such obstacles so that bar arrangement 100 can be placed without interfering or modifying obstacles in the bar or kitchen environment.

In the illustrated configuration, the leg assembly 102 can provide an accommodation space 142 adjacent to the underneath portion 118 of the body 106 of the bar arrangement 100. As shown in FIG. 2, the accommodation space 142 is positioned behind the rear leg 132 and generally between the rear leg 132 and the back side 114 of the body 106. Additionally, in the illustrated configuration, the accommodation space 142 is located between the rear leg 132 and the securing knob 136, however, other configurations are possible. In general, the leg assembly 102 allows a back leg of the bar arrangement 100 to be located or relocated without tools and moved away from a wall or other structure such that the back leg is moved toward the front side 108 of the body 106 and away from the wall 140.

In general, the leg assembly 102 provides a rear leg 132 that can be offset (i.e., in a horizontal direction relative to FIG. 2) from the back side 114 of the body 106. In some embodiments, the leg assembly 102 may define a distance d between the rear leg 132 and the wall 140. For example, in some configurations, the distance d may be approximately 5.5 inches so that there is an approximately 5.5 inch gap between the rear leg 132 and the wall 140 along which the bar arrangement 100 is positioned. In some embodiments, the distance d may be between 3 inches and 8 inches. In other configurations or embodiments, other distances are possible. For example, the mounting channel 134 may provide a variety of mount locations such that the rear leg 132 (or front leg 130) can be secured to the body 106 of the bar arrangement 100. Such mount locations may be at discrete positions that allow for particular and customizable accommodation spaces, such as the accommodation space 142, below the body 106. Alternatively, as will be described below with respect to FIGS. 8-10, a leg assembly can allow for continuous or infinite adjustment of one or more legs under a bar arrangement.

Figure 3:
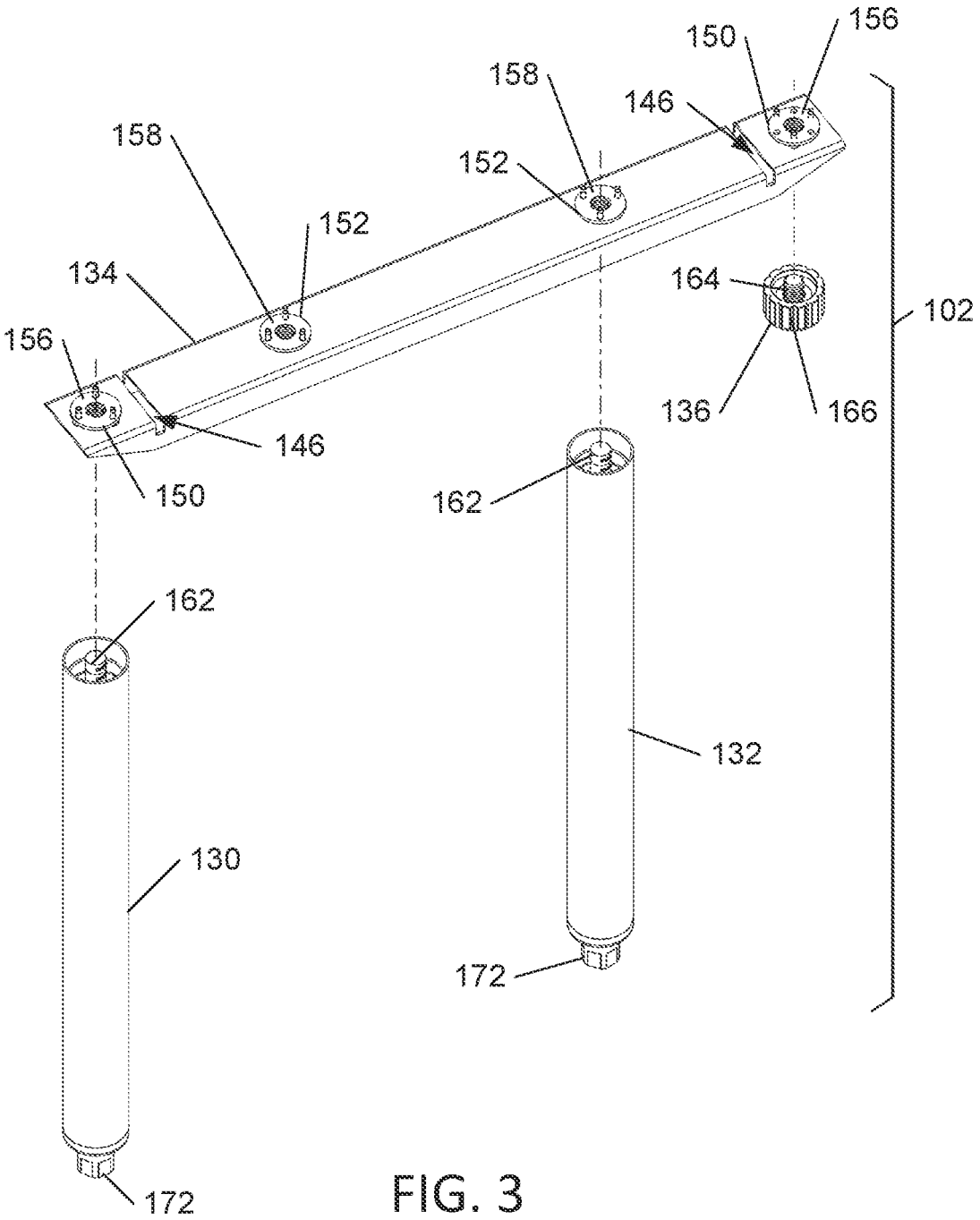
FIG. 3 is an exploded top isometric view of the leg assembly of FIG. 2.

With reference now to FIG. 3, the mounting channel 134 of the leg assembly 102 can provide a plurality of mount locations to accommodate the front and rear legs 130, 132 of the leg assembly 102. For example, in the illustrated embodiment, the mounting channel 134 includes first and second primary receiving nuts 150. Each of the primary receiving nuts 150 are disposed at opposing distal ends of the mounting channel 134. The mounting channel 134 can also include one or more secondary receiving nuts 152 that are disposed along a medial section of the mounting channel 134 between the primary receiving nuts 150.

Each of the front and rear legs 130, 132 can be configured to be secured to any one of the primary receiving nuts 150 or the secondary receiving nuts 152. For example, the front leg 130 can be received in a secondary receiving nut 152 so that a front accommodation space is provided between the front leg 130 and the front side 108 of the body 106. The front accommodation space may be in addition to or alternative to the accommodation space 142. Thus, the mounting channel 134 can provide a variety of mount locations for the legs 130, 132 to provide one or more accommodation spaces near the underneath portion 118 of the body 106. In yet another example, when multiple front and rear legs 130, 132 are used, at least one of the front and rear legs 130, 132 can be selectively staggered or offset (e.g., a front leg 130 offset from the front side 108 and/or a rear leg 132 offset from a back side 114, with the legs 130, 132 either along the same mounting channel 134 or associated with discrete mounting channels 134). In general, accommodation spaces can be provided by one or more of the front or rear legs 130, 132 being offset from a respective front side 108 or back side 114 of the body 106 at the underneath portion 118.

In general, the primary receiving nuts 150 can be used to secure the mounting channel 134 relative to the body 106 of the bar arrangement 100 and the secondary receiving nuts 152 can be used to secure one or more legs under the body 106 at a location that ordinarily (i.e., without the mounting channel 134) would not accommodate a leg. For example, in the configuration shown throughout FIGS. 1-7, the front leg 130 can be secured at one primary receiving nut 150, the securing knob 136 can be secured at the other primary receiving nut 150, and the rear leg 132 can be secured at one of the secondary receiving nuts 152.

The primary receiving nuts 150 can each include a body that is internally threaded and a head 156 that is generally configured as an annular flange. Similarly, the secondary receiving nuts 152 can each include a body that is internally threaded and a head 158 that is generally configured as an annular flange. Each of the front and rear legs 130, 132 can include a stud 162 at a top distal end of the leg 130, 132 that is externally threaded. The external threads of the studs 162 can be configured to be received by the internal threads of the receiving nuts 150, 152. Similarly, the securing knob 136 can include a threaded member 164 extending axially away from a grip portion 166 of the securing knob 136. The threaded member 164 can be dimensioned to be received by the internal threads of one of the receiving nuts 150, 152, and in particular, one of the primary receiving nuts 150.

The mounting channel 134 can further include on or more alignment slots 146 that can be used to align the leg assembly 102 at the underneath portion 118 of the bar arrangement 100. For example, the alignment slots 146 can receive a portion of the body 106 therein to align, strengthen, and enhance the rigid connection between the mounting channel 134 and the body 106 (see, for example, FIGS. 6 and 7). In some embodiments, the alignment slots 146 can provide a clamping force at the underneath portion 118 of the body 106 when the leg assembly 102 is secured and in a tightened configuration relative to the bar arrangement 100.

Figure 4:
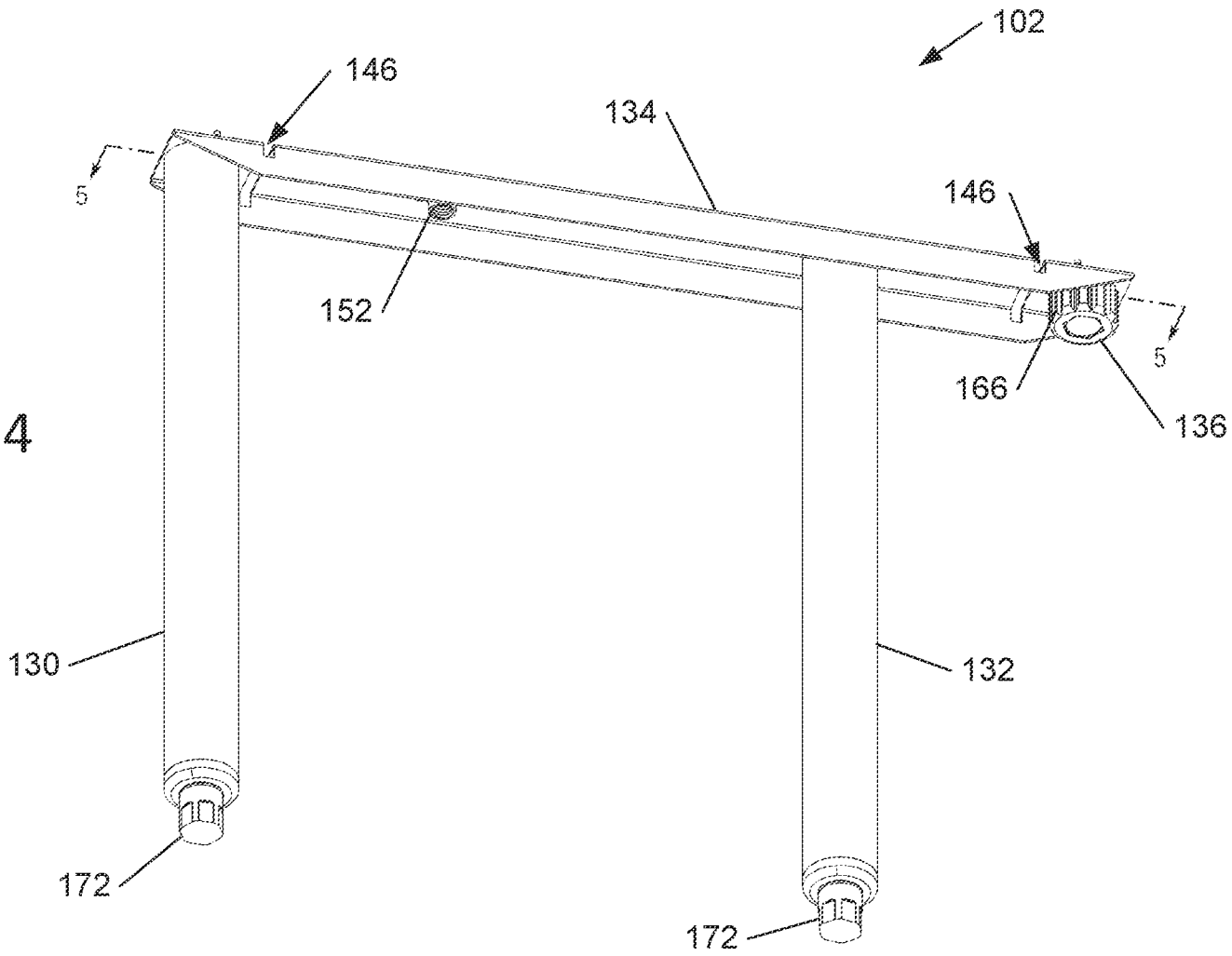
FIG. 4 is a bottom isometric view of the leg assembly of FIG. 2.

With reference to FIG. 4, each of the front leg 130 and the rear leg 132 can include a respective foot 172. Each foot 172 may be positioned at a bottom distal end of the respective leg 130, 132, opposite the stud 162. The foot 172 may be vertically adjustable relative to the respective leg 130, 132 so that the foot 172 can be positioned at a particular height to facilitate leveling the entire bar arrangement 100. For example, uneven flooring or other manufacturing inconsistencies may be remedied or accommodated for by adjusting the relative height of any leg 130, 132 via the adjustable foot 172. In some embodiments, the foot 172 may be threadably adjustable so that turning the foot 172 in a first direction lengthens the respective leg 130, 132, and turning the foot 172 in a second direction opposite to the first direction shortens the respective leg 130, 132.

Figure 5:
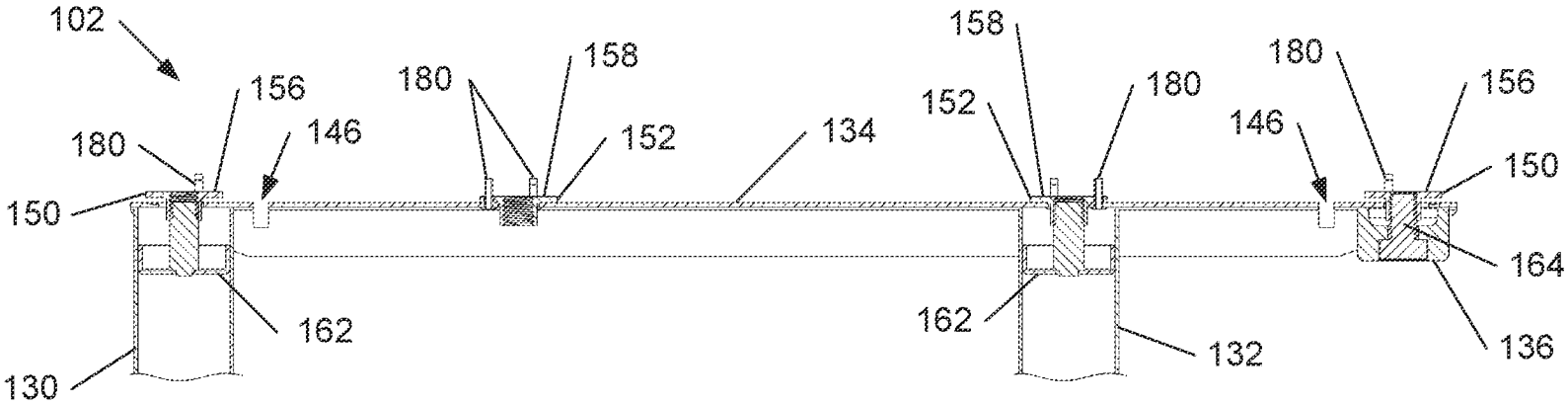
FIG. 5 is a cross-sectional side view of the leg assembly taken along line 5-5 of FIG. 4.

As further shown in FIGS. 4 and 5, each of the front and rear legs 130, 132 can be threadably received and secured relative to the mounting channel 134 by a respective one of the primary or secondary receiving nuts 150, 152. Similarly, the securing knob 136 can be threadably received and secured relative to the mounting channel 134 by one of the primary receiving nuts 150. In some embodiments, the studs 162 can be configured as welded studs 162 that are affixed to the legs 130, 132. The legs 130, 132 may define a generally hollow body that the studs 162 are received and welded within. The externally threaded portion of the studs 162 can extend beyond (i.e., outside of) the leg 130, 132 so that the threaded portion of the studs 162 can engage a respective receiving nut 150, 152.

In other embodiments, the studs 162 may be glued, adhered, pinned, or otherwise affixed within or to the respective legs 130, 132. Alternatively, in some embodiments, the studs 162 may be integrally formed with a portion of the leg 130, 132. Still, in other embodiments, the configuration of the internal threads of the receiving nuts 150, 152 and the external threads of the studs 162 and the threaded member 164 of the securing knob 136 may be reversed so that the threads of the receiving nuts 150, 152 are external and the threads of the studs 162 or threaded member 164 of the securing knob are internal. Additionally or alternatively, other connection types and constructions are possible (e.g., bayonet/cam connectors with interlocking posts/slots, ball detent connectors), which may similarly permit a toolless quick connection of a leg assembly to a bar arrangement.

As shown in FIG. 5, each of the heads 156, 158 of the receiving nuts 150, 152 can generally define a top side of the flange and a bottom side of the flange (relative to the orientation shown in FIG. 5). The bottom side of the flange of the head 156 of the primary receiving nut 150 may be dimensioned to be spaced apart from the mounting channel 134 and engage a surface 176 of the body 106 of the bar arrangement 100 (see FIG. 6). The surface 176 of the body 106 of the bar arrangement 100 may be an interior surface of a bottom portion of the body 106. In contrast, the bottom side of the flange of the head 158 of the secondary receiving nut 152 may be dimensioned to engage a surface of the mounting channel 134. Therefore, in the example embodiment, the primary receiving nuts 150 are configured to couple the mounting channel 134 to the body 106 via the leg 130 and the securing knob 136, while the secondary receiving nuts 152 are configured only to selectively couple to the mounting channel 134 and the leg 132.

Figure 6:
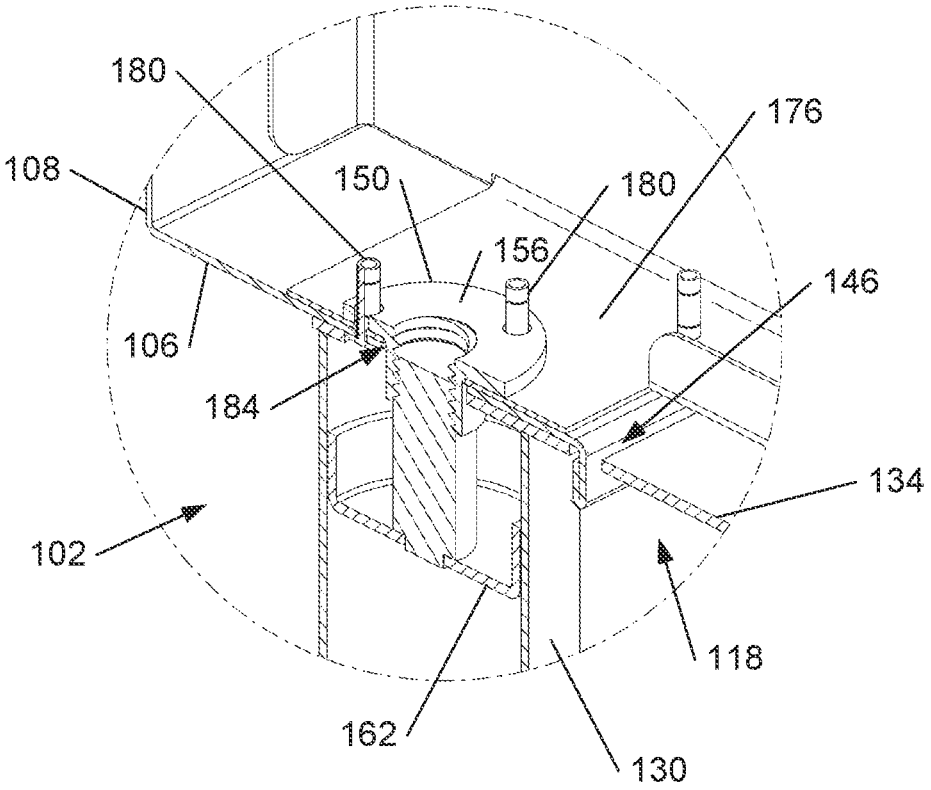
FIG. 6 is a zoomed-in cross-sectional isometric view of the bar arrangement and leg assembly taken along line 7-7 of FIG. 1.

With continued reference to FIGS. 5 and 6, some embodiments of the leg assembly 102 can include a plurality of alignment pins 180. The alignment pins 180 can extend from the mounting channel 134 and through each of an associated head 156, 158 of a receiving nut 150, 152. In use, the alignment pins 180 can be used to align a receiving nut 150, 152 through an opening formed in the mounting channel 134 and prohibit rotation of the receiving nut 150, 152 relative to the mounting channel 134 when a leg 130, 132 or securing knob 136 is threaded to the receiving nut 150, 152. In some embodiments, the alignment pins 180 can be configured as pins, rivets, pegs, etc. that may extend through or from the mounting channel 134.

During an assembly of the leg assembly 102 to the bar arrangement 100, the primary receiving nuts 150 may be separate from the mounting channel 134. The mounting channel 134 may then be aligned with the body 106 of the bar arrangement 100 along the underneath portion 118. The body 106 may include a first mount recess 184 at a front corner adjacent to the front 108 and lateral side 110 and a second mount recess 186 at a rear corner adjacent to the back 114 and lateral side 110 of the body 106 (see FIGS. 6 and 7). The mounting channel 134 can be aligned so that one primary receiving nut 150 can receive the alignment pins 180 at the first mount recess 184 and the other primary receiving nut 150 can receive the alignment pins 180 at the second mount recess 186 so that a portion of the body 106 (i.e., the surface 176) is positioned between the mounting channel 134 and the bottom side of the flange of the primary receiving nuts 150.

When the mounting channel 134 is aligned with the first and second mount recesses 184, 186 of the body 106 and the primary receiving nuts 150 are aligned and engaged with the alignment pins 180, the front leg 130 can be secured (i.e., via screwing) to one of the primary receiving nuts 150 and the securing knob can be secured (i.e., via screw) to the other primary receiving nut 150. As each of the front leg 130 and the securing knob 136 are tightened (i.e., rotated) relative to the mounting channel 134 via the primary receiving nuts 150, the mounting channel 134 is secured to the body 106 of the bar arrangement 100.

In general, the primary receiving nuts 150 can be used at or near the corners of the underneath portion 118 of the body 106 to facilitate a rigid assembly of the body 106 of the bar arrangement 100. For example, the interior surface 176 of the body 106 may be moveable relative to a portion of the body 106 to aid in manufacturing, shipping, assembly, and/or disassembly of the bar arrangement. Thus, when the primary receiving nuts 150 are secured relative to the mounting channel 134 and the body 106 via the stud 162 of one of the legs 130, 132 and/or the threaded member 164 of the securing knob 136, the interior surface 176 may be secured and the and the frame of the body 106 is strengthened.

Figure 7:
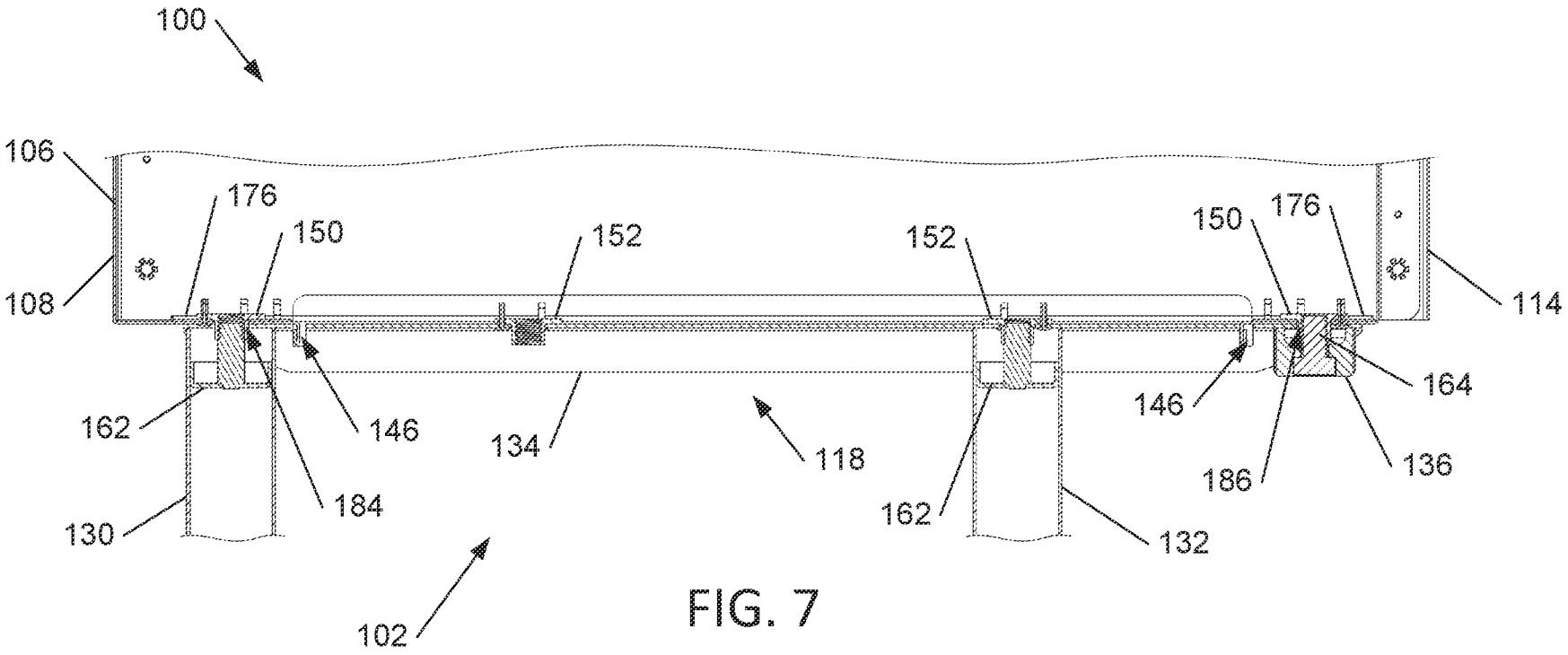
FIG. 7 is a cross-sectional side view of the bar arrangement and leg assembly taken along line 7-7 of FIG. 1.

As shown in FIG. 7, when the front leg 130 is secured at the first mount recess 184 of the body 106 and the securing knob 136 is secured to the second mounting recess 186 of the body 106, the mounting channel 134 extends generally horizontally between the front side 108 and the back side 114 of the body 106. It should be appreciated that when each of the primary receiving nuts 150 are occupied (via one or more legs and/or securing knobs), the mounting channel 134 may be in a secured configuration relative to the body 106. Thus, during an installation process, a leg, such as the rear leg 132 may be secured to the mounting channel 134 via the secondary receiving nut 152 independent from each of the front leg 130 and securing knob 136 being secured to a respective primary receiving nut 150. That is, the rear leg 132 may be secured relative to the mounting channel 134 before or after the mounting channel 134 is secured to the underneath portion 118 of the body 106.

With continued reference to FIG. 7, the illustrated embodiment includes a second secondary receiving nut 152 within the mounting channel 134 positioned between the front leg 130 and the rear leg 132. In some configurations, one of the legs 130, 132 may be alternatively received in the second secondary receiving nut 152 to form another configuration of the leg assembly 102. For example, in one configuration, the front leg 130 may be positioned more toward the back side 114 of the body 106 (relative to FIG. 7) and secured relative to the mounting channel 134 at the second secondary receiving nut 150. In such configuration, a second securing knob (not shown) similar to the securing knob 136 may be received by the primary receiving nut 150 at the first mount recess 184 to further secure the mounting channel 134 to the underneath portion 118 of the body 106.

In general, the mounting channel 134 according to embodiments of the invention provides a mount at the underneath portion 118 of the body 106 between the front side 108 and the back side 114. Often in conventional configurations of bar arrangements, the legs are at fixed locations, generally adjacent to four corners underneath the bar. Thus, embodiments of the present invention can provide a retrofittable, or otherwise separatable, leg assembly 102 that can be secured to a variety of existing or newly manufactured bar arrangements 100 to provide alternative and desirable mount locations for a plurality of underbar legs for a bar arrangement, such as the bar arrangement 100. Such desirable mount locations can include mount locations underneath the bar arrangement that permit vents, conduits, storage, or other kitchen elements and obstacles to coexist underneath the bar arrangement without interfering the underbar legs.

Additionally, while the leg assembly 102 in the illustrated embodiment provides two secondary receiving nuts 152 at intermediate positions along the mounting channel 134, it should be appreciated that alternative numbers of receiving nuts 152 at a variety of mount locations along the mounting channel 134 are possible. For example, if a bar arrangement is to be placed against a wall and the environment includes conduits along the wall and floor that protrude from the wall x inches, then a mounting channel according to embodiments of the invention can include a secondary receiving nut that would position a rear leg at approximately x inches (or slightly greater to account for variations and tolerances) away from the wall when installed on a bar arrangement, thereby tailoring an accommodation space underneath the bar to the particular environment.

Figure 8:
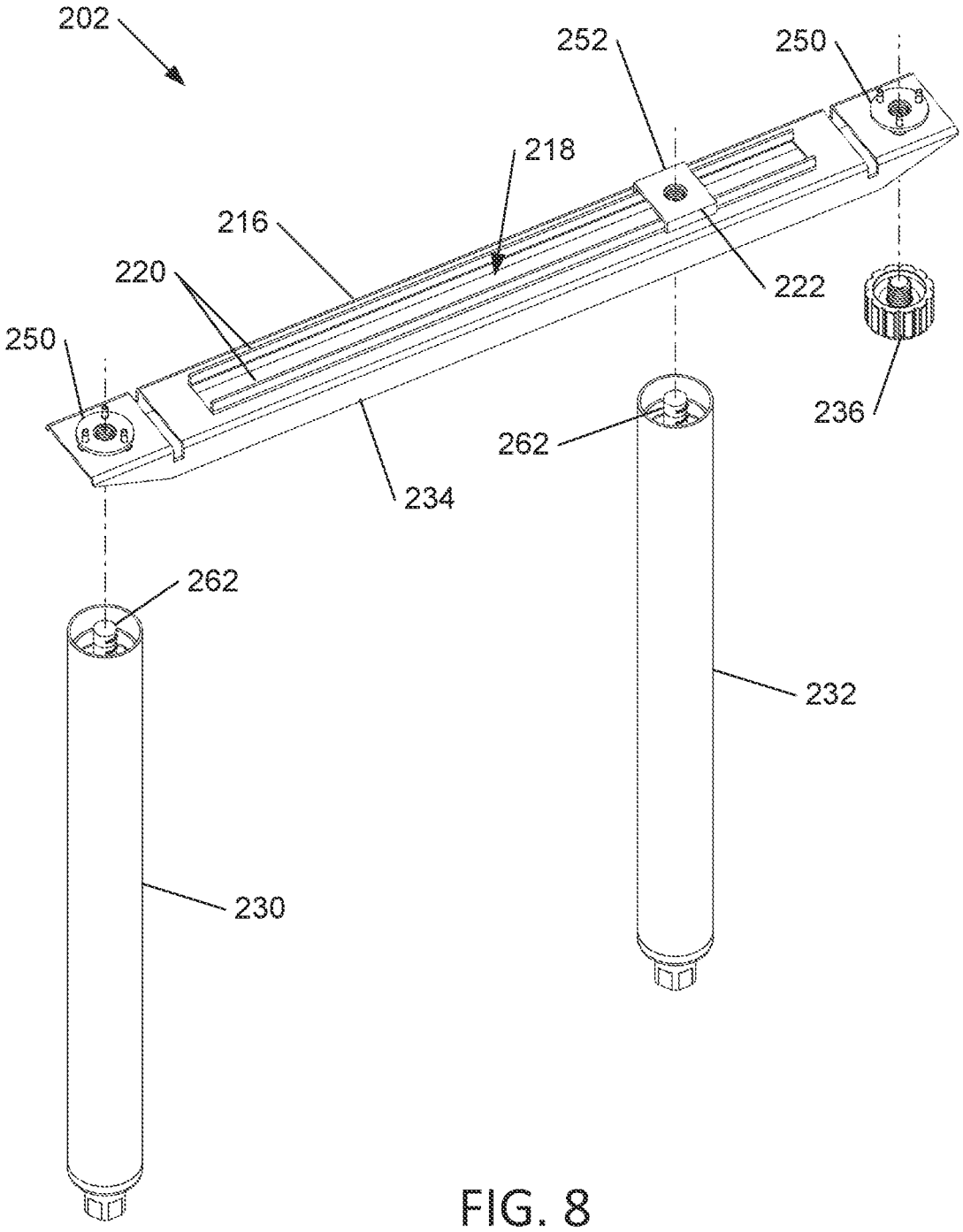
FIG. 8 is an exploded top isometric view of an example leg assembly according to another embodiment of the invention.
Figure 9:
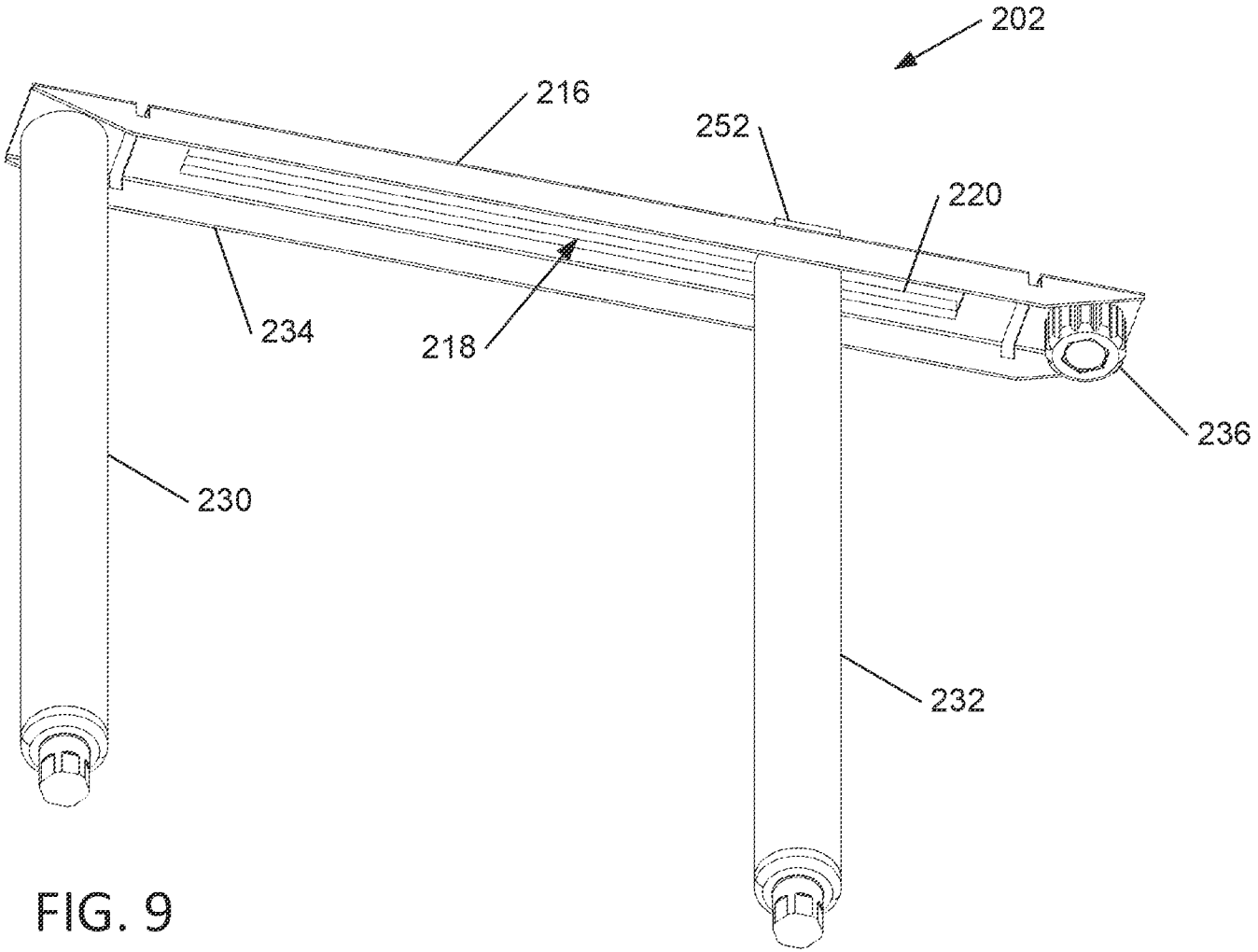
FIG. 9 is a bottom isometric view of the leg assembly of FIG. 8.
Figure 10:
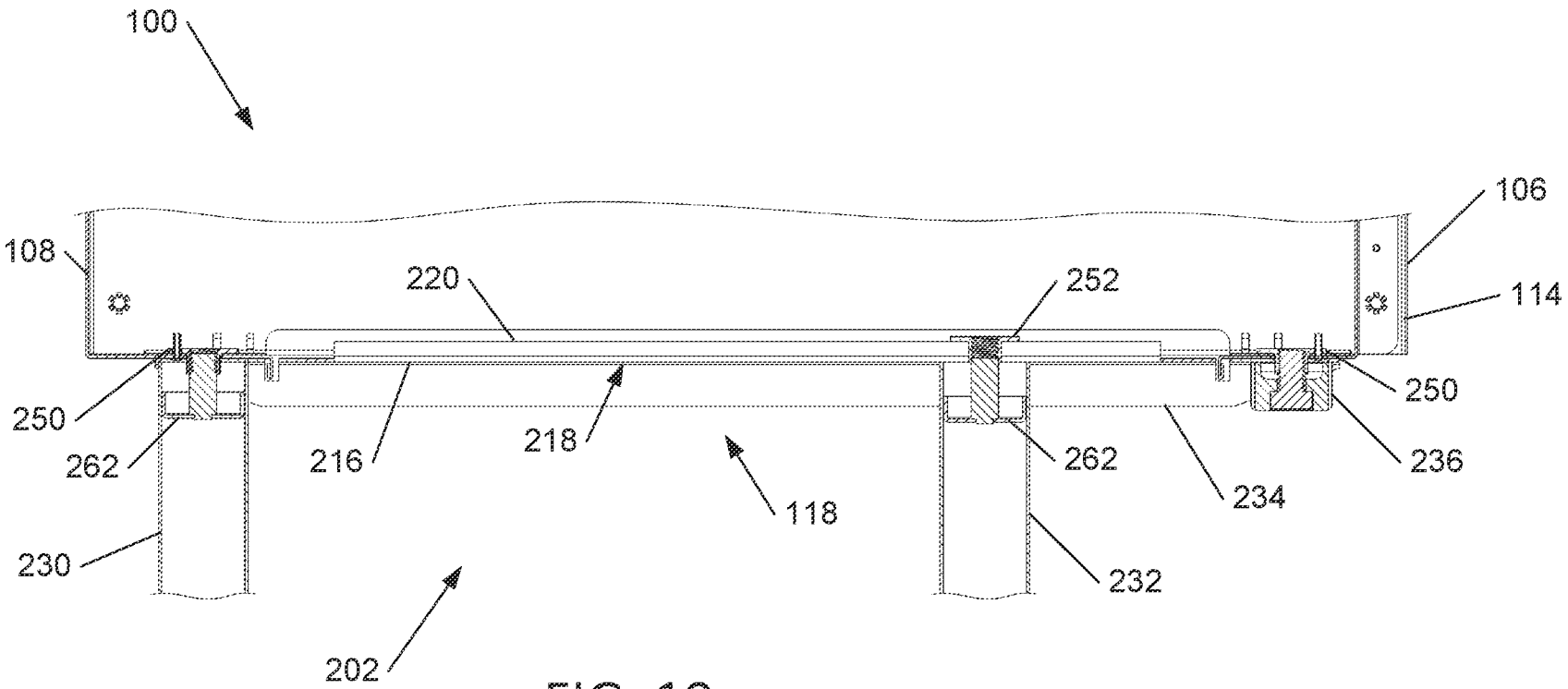
FIG. 10 is a cross-sectional side view of an example bar arrangement and the leg assembly of FIG. 8 according to an embodiment of the invention.

Referring now to FIGS. 8-10, a leg assembly 202 according to another embodiment of the invention is shown. In general, the leg assembly 202 provides an adjustable leg assembly for a bar arrangement. Some aspects of the leg assembly 202 are similar to the leg assembly 102, thus, similar elements will be described with like reference numbers where applicable. For example, the leg assembly 202 can include a front leg 230, a rear leg 232, a mounting channel 234, and a securing knob 236. In particular, the front leg 230, the rear leg 232, and the securing knob 236 may be substantially identical to the front leg 130, the rear leg 132, and the securing knob 136 of the leg assembly 102. Additionally, the leg assembly 202 can include primary receiving nuts 250 and one or more secondary receiving nuts 252.

In general, the interaction of each of the front leg 230 and the securing knob 236 with the primary receiving nuts 250 of the leg assembly 202 is substantially similar to the interaction associated with like components of the leg assembly 102, and thus will not be described in further detail to avoid repetition. In this regard, it should be appreciated that the leg assembly 202 can be secured to a body of a bar arrangement, such as the bar arrangement 100, similarly to the leg assembly 102 (see, for example, FIG. 10).

With continued reference to FIG. 8, the mounting channel 234 can define a body 216 having a slot 218 formed therein. In the illustrated embodiment, the slot 218 is formed as an elongated closed slot and generally extends longitudinally between two distal ends of the mounting channel 234 between the primary receiving nuts 250. The slot 218 is dimensioned to receive a secondary receiving nut 252 that is slidable along the length of the slot 218. In the illustrated embodiment, the mounting channel 234 further includes a track 220 that extends longitudinally along both sides of the slot 218. The secondary receiving nut 252 includes corresponding arms 222 dimensioned to engage the track 220.

In use, the secondary receiving nut 252 is enabled to move along the length of the mounting channel 234 via the track 220 and the slot 218 allows a stud 262 of the rear leg 232 to extend through the body 216 of the mounting channel 234 to engage the internal threads of the secondary receiving nut 252. Thus, the rear leg 232 (or optionally, the front leg 230) can be infinitely adjustable along the length of the slot 218. In other embodiments, the mounting channel 234 may include demarcations or other physical incrementations that would allow the secondary receiving nut 252 to be adjusted along the track 220 at specific predefined increments. Such specific increments can relate to certain distances of the rear leg 232 from a reference point, such as a back wall along which a back side of the bar arrangement is placed.

In some embodiments, when the rear leg 232 is received by the secondary receiving nut 252 (see, for example, FIGS. 9 and 10), the leg 232 may be slid and positioned along the track. When the leg 232 is at a desired position, the leg may be tightened (e.g., rotated) relative to the secondary receiving nut 252 so that a clamping force is imparted on the mounting channel 234 from the secondary receiving nut 252. During assembly or disassembly, the secondary receiving nut 252 is inhibited from rotation by the interaction between the arms 222 of the secondary receiving nut 252 and the track 220. As the secondary receiving nut 252 is clamped onto the mounting channel 234, the position of the leg 232 along the slot 218 may be secured.

Similar to the leg assembly 102, the leg assembly 202 can be secured relative to a body of a bar arrangement, such as the bar arrangement 100 without the use of tools. In general, the toolless connection of the mounting channel 234 to a bar arrangement is enabled by the example threaded connection of the front leg 230 and one primary receiving nut 250 and the example threaded connection of the securing knob 236 and the other primary receiving nut 250. Additionally, the toolless connection of the rear leg 232 to the mounting channel 234 is further enabled by the example threaded connection of the rear leg 232 and the secondary receiving nut 252.

While threaded connections are used to impart a toolless connection of the leg assemblies 102, 202 to a bar arrangement according to some embodiments of the invention, it should be appreciated that other toolless (or tooled) connections are possible. For example, other leg assemblies according to embodiments of the invention can include a variety of connection types, including snapped, slidable, or pinned connections.

Additionally, it should be appreciated that while the mounting channels 134, 234 are shown to be secured to the bar arrangement 100 in an orientation that is generally parallel and adjacent to one of the lateral sides 110, 112 of the body 106 of the bar arrangement, other orientations of the mounting channels 134, 234 are possible. For example, mounting channels according to embodiments of the invention may extend in any direction at the underneath portion 118 of the body 106 of the bar arrangement 100 or other bar arrangements.

In some implementations, devices or systems disclosed herein can be utilized, manufactured, or installed using methods embodying aspects of the invention. Correspondingly, any description herein of particular features, capabilities, or intended purposes of a device or system is generally intended to include disclosure of a method of using such devices for the intended purposes, a method of otherwise implementing such capabilities, a method of manufacturing relevant components of such a device or system (or the device or system as a whole), and a method of installing disclosed (or otherwise known) components to support such purposes or capabilities. Similarly, unless otherwise indicated or limited, discussion herein of any method of manufacturing or using for a particular device or system, including installing the device or system, is intended to inherently include disclosure, as embodiments of the invention, of the utilized features and implemented capabilities of such device or system.

The previous description of the disclosed embodiments is provided to enable any person skilled in the art to make or use the invention. Given the benefit of this disclosure, various modifications to these embodiments will be readily apparent to those skilled in the art, and the principles defined herein may be applied to other embodiments without departing from the spirit or scope of the invention. Thus, the invention is not intended to be limited to the embodiments shown herein but is to be accorded the widest scope consistent with the principles and novel features disclosed herein.

The invention claimed is:

1. A leg assembly for a bar arrangement defining a back side for arranging along a wall and a front side opposite to the back side, the leg assembly comprising:

a mounting channel for engaging the bar arrangement at an underneath portion of the bar arrangement;

a first leg secured relative to the mounting channel via a first primary receiving nut adjacent to the front side of the bar arrangement;

a securing knob secured relative to the mounting channel via a second primary receiving nut adjacent to the back side of the bar arrangement; and a second leg secured to the mounting channel via a first secondary receiving nut, the second leg secured along the mounting channel at a position between the first leg and the securing knob to form an accommodation space at the underneath portion of the bar arrangement between the second leg and the wall.

2. The leg assembly of claim 1, wherein the second leg is offset from the wall by an offset distance.

3. The leg assembly of claim 2, wherein the offset distance is 5.5 inches.

4. The leg assembly of claim 1, wherein the first leg includes a threaded stud dimensioned to be threadably received by the first primary receiving nut and the second leg includes a threaded stud dimensioned to be threadably received by the first secondary receiving nut.

5. The leg assembly of claim 1, wherein the securing knob includes a grip portion and a threaded member, the threaded member dimensioned to be threadably received by the second primary receiving nut.

6. The leg assembly of claim 1, wherein the mounting channel includes a slot and the second leg is infinitely adjustable within the mounting channel along a length of the slot.

7. The leg assembly of claim 1, wherein each of the first leg, the second leg, and the securing knob can be secured to the mounting channel, and thus the bar arrangement, without tools.

8. The leg assembly of claim 1, wherein the first and second primary receiving nuts are configured to secure the mounting channel to the bar arrangement via the first leg and the securing knob.

9. The leg assembly of claim 1, wherein the second leg is configured to be secured to the mounting channel independent of the mounting channel being secured to the bar arrangement.

10. The leg assembly of claim 1, wherein a portion of the bar arrangement is configured to be clamped between the first primary receiving nut and the first leg.

11. A leg assembly for a bar arrangement defining a back side for arranging along a wall and a front side opposite to the back side, the leg assembly comprising:

a mounting channel for engaging the bar arrangement at an underneath portion of the bar arrangement, the mounting channel having first and second distal ends;

a first primary receiving nut disposed at the first distal end of the mounting channel;

a second primary receiving nut disposed at the second distal end of the mounting channel;

a securing knob secured relative to the mounting channel via the first primary receiving nut or the second primary receiving nut;

a first leg secured relative to the mounting channel; and a second leg secured relative to the mounting channel, the second leg secured relative to the mounting channel at a position between the first leg and the securing knob to form an accommodation space at the underneath portion of the bar arrangement between the second leg and the front side of the bar arrangement or between the second leg and the back side of the bar arrangement.

12. The leg assembly of claim 11, wherein the accommodation space is formed by the second leg secured to the mounting channel via a secondary receiving nut that is offset from one of the first distal end or the second distal end of the mounting channel.

13. The leg assembly of claim 12, wherein the mounting channel includes a track and the secondary receiving nut includes arms dimensioned to engage the track, the secondary receiving nut infinitely adjustable along the track.

14. The leg assembly of claim 13, wherein the arms extend longitudinally along the track so that the secondary receiving nut is inhibited from rotation by an interaction between the arms and the track when the second leg is rotated relative to the track and received by the secondary receiving nut.

15. The leg assembly of claim 11, wherein the mounting channel includes first and second secondary receiving nuts arranged between the first and second primary receiving nuts.

16. The leg assembly of claim 11, wherein the mounting channel extends between the back side and the front side of the bar arrangement.

17. The leg assembly of claim 11, wherein the accommodation space is formed between the second leg and the wall.

18. The leg assembly of claim 11, further comprising:

one or more alignment pins that extend from the mounting channel and through a head of the first primary receiving nut to secure the first primary receiving nut laterally between the first and second distal ends of the mounting channel.

19. The leg assembly of claim 18, wherein the one or more alignment pins includes at least first and second alignment pins, the first and second alignment pins configured to prohibit rotation of the first primary receiving nut relative to the mounting channel.

20. A method for adjusting a leg assembly for a bar arrangement, the bar arrangement defining a back side for arranging along a wall and a front side opposite to the back side, the method comprising:

securing a first distal end of a mounting channel to the bar arrangement by securing a first leg to a first primary receiving nut;

securing a second distal end of the mounting channel to the bar arrangement by securing a knob to a second primary receiving nut;

slidably securing a second leg to the mounting channel via a secondary receiving nut, the second leg positioned between the first leg and the knob;

adjusting the position of the second leg along the mounting channel to form an accommodation space between the second leg and the wall; and securing the second leg relative to the mounting channel by rotating the second leg relative to the secondary receiving nut.

* * * * *